United States Patent [19]

Seki et al.

[11] Patent Number: 4,775,605

[45] Date of Patent: Oct. 4, 1988

[54] LAYERED PHOTOSENSITIVE MATERIAL FOR ELECTROPHOTOGRAPHY

[75] Inventors: Kenji Seki; Katsuichi Ohta, both of Mishima; Kiyoshi Masuda, Numazu; Hirofumi Yamanami, Numazu; Satomi Mochizuki, Numazu, all of Japan

[73] Assignee: Ricoh Co., Ltd., Tokyo, Japan

[21] Appl. No.: 948,254

[22] Filed: Dec. 31, 1986

[30] Foreign Application Priority Data

Jan. 9, 1986 [JP] Japan ..... 61-3090
Jul. 9, 1986 [JP] Japan ..... 61-162827

[51] Int. Cl.[4] ..... G03G 5/14
[52] U.S. Cl. ..... 430/63; 430/900
[58] Field of Search ..... 430/63, 64, 62

[56] References Cited

U.S. PATENT DOCUMENTS 3,950,169 4/1976 Timmerman et al. ..... 430/62
4,377,629 3/1983 Tarumi et al. ..... 430/63 X
4,416,963 11/1983 Takimoto et al. ..... 430/69
4,518,669 5/1985 Yashiki ..... 430/63 X

FOREIGN PATENT DOCUMENTS 3114626 4/1981 Fed. Rep. of Germany .

*Primary Examiner*—J. David Welsh
*Attorney, Agent, or Firm*—Flynn, Thiel, Boutell & Tanis

[57] ABSTRACT

This invention relates to a repeatedly usable photosensitive material for electrophotography, comprising an electroconductive substrate, a photosensitive layer and an intermediate layer located between said electroconductive substrate and said photosensitive layer, characterized in that said intermediate layer comprises an electroconductive polymer and an inorganic white pigment.

15 Claims, No Drawings

LAYERED PHOTOSENSITIVE MATERIAL FOR ELECTROPHOTOGRAPHY

BACKGROUND OF THE INVENTION (a) Technical Field of the Invention

The present invention relates to a photosensitive material for electrophotography. More particularly, the present invention relates to an electrophotographic photosensitive material repeatedly usable by a PPC copier, laser beam printer, digital copier or the like, the intermediate layer of which is improved.

(b) Description of the Prior Art

Generally, a repeatedly usable photosensitive material (hereinafter referred to simply as "photosensitive material") has an intermediate layer comprising a resin of a relatively low resistance between a substrate and a photosensitive layer in order to obtain a favorable electrostatic property (to block the injection of unnecessary electric charge and to maintain an appropriate charge acceptance) and further to improve the adhesive property of the photosensitive layer with the substrate.

Examples of a resin conventionally used for the intermediate layer include (i) a water soluble resin such as casein, polyvinyl alcohol and the like, (ii) a polyamide resin such as nylon, copolymerized nylon and the like, (iii) light-curable or thermosetting resins, and the like. However, the conventional photosensitive material, the intermediate layer of which is made from the above mentioned resins, has disadvantages such as the residual potential increasing because the intermediate layer becomes highly resistant at a low moisture, and, as a consequence that the sensitivity of the photosensitive material is lowered.

There were various methods proposed to remove the above mentioned disadvantages, for example, adding an electroconductive pigment such as indium oxide, tin oxide, carbon and the like to the intermediate layer (see Japanese Patent Laid Open No. 58-93063) or adding an electroconductive polymer to the intermediate layer (see Japanese Patent Laid Open No. 58-95744). However, these methods still have some problems for practical use. For example, in the former method, it was necessary to form a second intermediate layer consisting of a resin only between the photosensitive layer and the intermediate layer containing the electroconductive pigment in order to prevent the electrostatic property of the photosensitive material from lowering. In the latter method, the sensitivity is lowered although the electrostatic property does not degrade too much.

In the case of a multi-layered type photosensitive material, the photosensitive layer of which is formed by laminating a charge generating layer and a charge transfer layer, the moire phenomenon often occurs between a substrate and the surface of the charge transfer layer by multi-reflection. In order to prevent the occurrence of the moire phenomenon, it has been proposed to add a light-dispersing material to an intermediate layer. However, even in the case of this photosensitive material, the electrostatic property is lowered and the residual potential is increased during repeated use. Thus, this photosensitive material also needs to be improved.

SUMMARY OF THE INVENTION

An object of this invention is to provide a photosensitive material for electrophotography, the properties of which are improved without damaging its photosensitive properties. The improved photosensitive material is not influenced by humidity, the residual potential is not increased even at a low humidity, and its various properties not degrade during repeatedly using.

Another object of this invention is to provide a repeatedly usable organic type photosensitive material (particularly multi-layered type photosensitive material), the photosensitive material and the substrate of which are strongly bonded each other by positioning an intermediate layer therebetween, and which does not cause moire.

The above mentioned objects can be achieved by providing a repeatedly usable photosensitive material for electrophotography, comprising an electroconductive substrate, a photosensitive layer and an intermediate layer located between said electroconductive substrate and said photosensitive layer, characterized in that said intermediate layer comprises an electroconductive polymer and an inorganic white pigment.

DETAILED DESCRIPTION OF THE INVENTION

The repeatedly usable photosensitive material for electrophotography of the present invention comprises an electroconductive substrate, a photosensitive layer and an intermediate layer located between said electroconductive substrate and said photosensitive layer, said intermediate layer being characterized by containing an electroconductive polymer and an inorganic white pigment.

We have found that the increase of the residual potential can be prevented by adding an electroconductive polymer to an intermediate layer and that the decrease of sensitivity can be prevented by adding an inorganic white pigment to the same intermediate layer. We have also found that the addition of the inorganic white pigment further prevent the occurrence of moire. The present invention is based on these discoveries.

The present invention is more fully described hereinafter.

As mentioned above, the photosensitive material for electrophotography of the present invention comprises an intermediate layer and a photosensitive layer laminated on an electroconductive substrate in order.

Examples of the electroconductive substrate include metals such as aluminum, nickel, stainless and the like; plastics having electroconductive pigments (such as carbon and the like) dispersed; insulative substrates (plastic or plastic film) prepared by vapor-depositing metals or coating an electroconductive paint thereon; and the like.

Examples of the electroconductive polymer used in the intermediate layer include an anion type electroconductive polymer represented by a polymer containing sulfonic acid, an alkali metal salt of sulfonic acid (for example, sodium sulfonate) or ammonium sulfonate; a cation type electroconductive polymer represented by a polymer containing a quaternary ammonium salt; and the like. Among them, an anion type polymer is particularly preferable.

Examples of the inorganic white pigment used in said intermediate layer include a pigment having a refractive index of not less than 1.9 on the basis of a visible radiation or a near infrared radiation, such as titanium dioxide, zinc oxide, zinc sulfide, white lead, lithopone, and the like. Among them, a particularly preferable inorganic white pigment is a "titanium oxide pigment without surface treatment". The "titanium oxide pigment without surface treatment" means a titanium dioxide belonging to Anatase type Class I, the surface of which is not treated, as defined in JIS-K5116. Commercially available titanium oxides include two types, one of which is surface-treated with a solution of hydrate oxide of Al and Si, and the other of which is not surface-treated. It is preferable for the present invention to use the latter type of titanium dioxide with no such surface treatment. Furthermore, titanium oxides are classified into two groups, i.e. anatase type and rutile type. In the present invention, it is preferable to use anatase type titanium oxide.

An intermediate layer may comprise said electroconductive polymer and said inorganic white pigment only, but it may further contain a binder (resin of low resistance) conventionally used. However, the binder used herein should satisfy the conditions of being dissolved in a solvent for said electroconductive polymer and of not being attacked by a photosensitive layer-forming solution to be coated on said intermediate layer. Preferable examples of a binder which satisfies these conditions, include resins soluble in water or alcohol, such as polyvinyl alcohol, sodium polyacrylate, CMC, casein, sodium alginate, nylon, copolymerized nylon, alkoxymethylated nylon, and the like.

An intermediate layer is formed by dispersing the above mentioned inorganic white pigment, electroconductive polymer, solvent and, if necessary, binder in a ball mill, coating the resultant dispersion on an electroconductive substrate, and drying the substrate having the dispersion coated thereon. The intermediate layer thus coated on the substrate preferably has a thickness of about 0.3 to 20 μm.

The mixing ratio of an electroconductive polymer, inorganic white pigment and binder varies depending on the materials used and is not uniformly determined. However, it is generally preferable to use the inorganic white pigment in an amount of 0.05 to 10 parts by weight per one part by weight of the total amount of the electroconductive polymer and the binder. The binder is generally used in an amount of 0 to 200 parts by weight, preferably 10 to 200 parts by weight per one part by weight of the electroconductive polymer.

The photosensitive layer used in the present invention may be any of the conventionally known photosensitive materials, examples of which include (1) one having a charge transfer complex formed by a combination of an electron donor compound and an electron acceptor compound (see U.S. Pat. No. 3,484,237); (2) one having an organic photoconductive material sensitized by the addition of dye (see Japanese Patent Publication No. 48-25658); (3) one having pigment dispersed in a positive hole or electron-active matrix (see Japanese Patent Laid Open Nos. 47-30328 and 47-18545); (4) one having separate functions of charge generating layer and charge transfer layer (see Japanese Patent Laid Open No. 49-105537); (5) one containing an eutectic complex comprising dye and resin as the main components (see Japanese Patent Laid Open No. 47-10785); (6) one having an organic pigment or inorganic charge generating material added to a charge transfer complex (see Japanese Patent Laid Open No. 49-91648; and the like.

However, among these photosensitive materials, the multi-layered type photosensitive material of the above mentioned type (4) is preferable since it has a high sensitivity and the materials used can be freely selected depending on their functions. The charge generating layer can be formed by dispersing a charge generating material such as azo type pigment, phthalocyanine type pigment, indigo type pigment, perylene type pigment, squaric type pigment, selenium powder, selenium alloy powder, amorphous silicon powder, zinc oxide powder, cadmium sulfide powder, and the like, in a binder resin solution of polyester, polycarbonate, polyvinyl butyral, acrylic resin, and the like, and coating the above prepared dispersion on an intermediate layer. The charge generating layer preferably has a thickness of about 0.01 to 2 μm. The charge transfer layer can be formed by dissolving a charge transfer material such as styryl compounds including α-phenyl stilbene compound (see Japanese Patent Laid Open No. 58-198043), hydrazone compounds (see Japanese Patent Laid Open No. 55-46760), pyrazoline compounds, oxadiazole compounds, and the like, in a film-forming resin such as polyester, polysulfone, polycarbonate, polymethacrylate, polystyrene and the like, and coating the above prepared solution on a charge generating layer in such a manner as to make a thickness of about 10 to 30 μm. The reason why a film-forming resin is used, is that a charge transfer material generally has a low molecular weight and is poor in film-formability.

The photosensitive material thus prepared is suitable for repeated use. If necessary, the surface of the photosensitive layer of the present invention may be covered with a protective layer in the same manner as in the conventional photosensitive materials.

The present invention is further illustrated by the following Examples and Comparative Examples, but is not limited thereto.

EXAMPLE 1

10 g of an alcohol-soluble copolymerized nylon (CM-4000 manufactured by Toray Industries Inc.) was dissolved in 100 g of methanol. 0.8 g of a cation type electroconductive polymer (polydimethyl diallyl ammonium chloride, "CP-280" manufactured by Calgon Inc. of U.S.A.) and 5 g of a surface-treated titanium oxide powder having a refractive index of 2.71 ("Tipaque R-670" manufactured by Ishihara Sangyo Kaisha, Ltd.) were added to the above prepared solution, and the resultant mixture was dispersed in a ball mill for 12 hours. The coating solution thus prepared was coated on the surface of an aluminum plate (electroconductive substrate) having a thickness of 0.2 mm by dipping, and the coated substrate was dried at 110° C. for 5 minutes, thus forming an intermediate layer of a film thickness of about 2 μm.

On the other hand, 5 g of polyester resin ("Vylon 200" manufactured by Toyo Boseki Kabushiki Kaisha) was dissolved in 150 g of cyclohexanone, and 10 g of the bisazo pigment having the following chemical structural formula was added to the above prepared resinous solution.

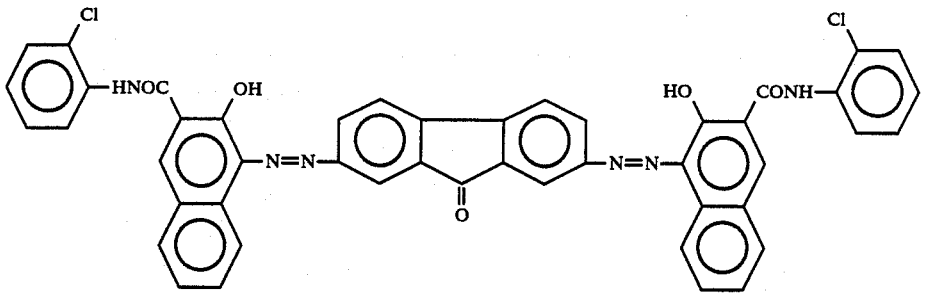

The resultant mixture was fully dispersed in a ball mill for 48 hours. Thereafter, 210 g of cyclohexanone was added to the above prepared dispersion, and the resultant dispersion was further dispersed for 3 hours. The dispersion was then taken out of the container and diluted with cyclohexanone in such a manner as to make a solid content of 1% by weight while stirring, thus preparing a solution for forming a charge generating layer.

The above prepared solution for forming a charge generating layer was coated on the above formed intermediate layer by dipping, and the coated material was dried at 120° C. for 5 minutes, thus forming a charge generating layer having a thickness of about 0.3μ.

Furthermore, 12 g of polycarbonate resin (Panlite K-1300 manufactured by Teijin Limited) was dissolved in 90 g of tetrahydrofuran, and 7 g of the charge transfer material having the following chemical structural formula was dissolved in the above prepared resinous solution.

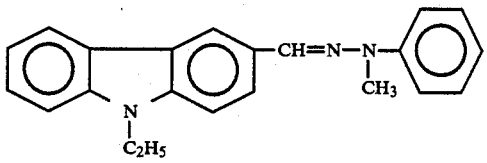

The above prepared solution was coated on the above formed charge generating layer by dipping, and the coated material was dried at 120° C. for 15 minutes, thus forming a charge transfer layer having a thickness of about 18 μm. In this manner, the preparation of a layered type photosensitive material for electrophotography was completed.

COMPARATIVE EXAMPLE 1-a

A comparative photosensitive material was prepared in the same manner as in Example 1, except that titanium oxide was removed from the intermediate layer.

COMPARATIVE EXAMPLE 1-b

A comparative photosensitive material was prepared in the same manner as in Example 1, except that the electroconductive polymer was removed from the intermediate layer.

EXAMPLE 2

10 g of an alcohol-soluble copolymerized nylon (Daiamide X-1874 manufactured by Daicel Ltd.) was dissolved in 100 g of methanol. 0.7 g of a cation type electroconductive polymer (polystyrene having a substituent of aliphatic quaternary ammonium salt. "Chemistat 6300" manufactured by Sanyo Chemical Industries Ltd.) and 7 g of zinc sulfide powder having a refractive index of 2.37 (manufactured by Shimakyu Yakuhin Co. Ltd.) were added to the above prepared solution, and the resultant mixture was dispersed in a ball mill for 12 hours. The coating solution thus prepared was coated on the surface of aluminum plate (electroconductive substrate) of a thickness of 0.2 mm by dipping, and the coated substrate was dried at 110° C. for 5 minutes, thus forming an intermediate layer of a film thickness of about 3 μm.

On the other hand, 5 g of the same bisazo pigment as used in Example 1 was added to 100 g of tetrahydrofuran, and the resultant mixture was dispersed in a ball mill for 48 hours. Thereafter, 400 g of tetrahydrofuran was added to the above prepared dispersion, and the resultant dispersion was further stirred, thus preparing a solution for forming a charge generating layer.

The above prepared solution for forming a charge generating layer was coated on the above formed intermediate layer by dipping, and the coated material was dried at 120° C. for 5 minutes, thus forming a charge generating layer having a thickness of about 0.3 μm.

Furthermore, 12 g of polycarbonate resin (Panlite K-1300 manufactured by Teijin Limited) was dissolved in 90 g of tetrahydrofuran, and 7 g of the charge transfer material having the following chemical structural formula was dissolved in the above prepared resinous solution.

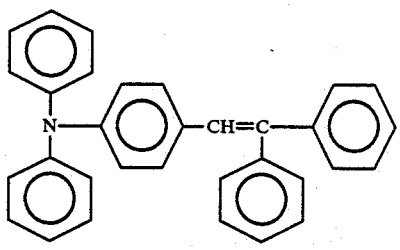

The above prepared solution was coated on the above formed charge generating layer by dipping, and the coated material was dried at 120° C. for 15 minutes, thus forming a charge transfer layer having a thickness of about 20 μm. In this manner, the preparation of a layered type photosensitive material for electrophotography was completed.

COMPARATIVE EXAMPLE 2-a

A comparative photosensitive material was prepared in the same manner as in Example 2, except that zinc sulfide was removed from the intermediate layer.

COMPARATIVE EXAMPLE 2-b

A comparative photosensitive material was prepared in the same manner as in Example 2, except that the electroconductive polymer was removed from the intermediate layer.

EXAMPLE 3

100 g of water and 0.5 ml of conc. aqueous ammonia (concentration 38%) were added to 10 g of milk casein (manufactured by Kanto Kagaku Co.), and the casein was dissolved while heating at 70° C. with stirring. 1.0 g of an anion type electroconductive polymer (ammonium polystyrene sulfonate "VERSA-TL 125" manufactured by Kanebo NSC Co.) and 5.0 g of zinc oxide powder having a refractive index of 2.03 (manufactured by Sakai Kagaku Co.) were added to the above prepared solution, and the resultant mixture was dispersed in a ball mill for 5 hours. The coating solution thus prepared was coated on the surface of an aluminum plate (electroconductive substrate) having a thickness of 0.2 mm by dipping, and the coated substrate was dried at 120° C. for 5 minutes, thus forming an intermediate layer of a film thickness of about 2.5 μm.

On the other hand, 5 g of butyral resin ("SLEC BL-S" manufactured by Sekisui Chemical Co., Ltd.) was dissolved in 150 g of cyclohexanone, and 10 g of the trisazo pigment having the following chemical structural formula was added to the above prepared resinous solution.

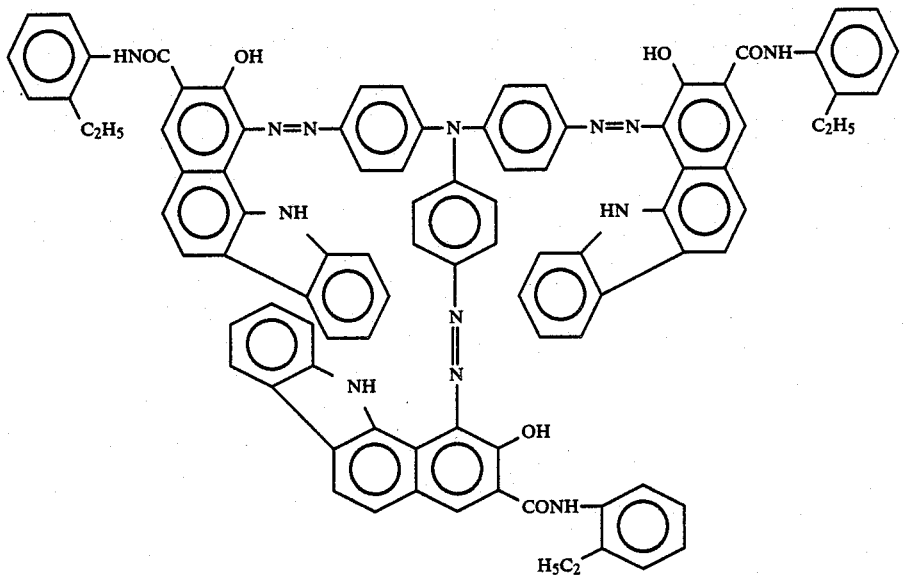

The resultant mixture was fully dispersed in a ball mill for 48 hours. Thereafter, 210 g of cyclohexanone was added to the above prepared dispersion, and the resultant dispersion was further dispersed for 3 hours. the dispersion was then taken out of the container and diluted with cyclohexanone in such a manner as to make a solid content of 1.5% by weight while stirring, thus preparing a solution for forming a charge generating layer.

The above prepared solution for forming a charge generating layer was coated on the above formed intermediate layer by dipping, and the coated material was dried at 120° C. for 5 minutes, thus forming a charge generating layer having a thickness of about 0.3 μm.

Furthermore, the same charge transfer layer as used in Example 1 was formed on the above prepared charge generating layer, thus producing a layered type photosensitive material for electrophotography.

COMPARATIVE EXAMPLE 3-a

A comparative photosensitive material was prepared in the same manner as in Example 3, except that zinc oxide was removed from the intermediate layer.

COMPARATIVE EXAMPLE 3-b

A comparative photosensitive material was prepared in the same manner as in Example 3, except that the electroconductive polymer was removed from the intermediate layer.

EXAMPLE 4

10 g of an alcohol-soluble copolymerized nylon (CM-8000 manufactured by Toray Industries Inc.) was dissolved in 100 g of methanol. 1 g of an anion type electroconductive polymer (sodium polystyrene sulfonate, "Chemistat 6120" manufactured by Sanyo Chemical Industries Ltd.) and 5 g of titanium oxide powder having a refractive index of 2.52 ("A-100" manufactured by Ishihara Sangyo Kaisha, Ltd.) were added to the above prepared solution, and the resultant mixture was dispersed in a ball mill for 12 hours. The coating solution thus prepared was coated on the surface of an aluminum plate (electroconductive substrate) of a thickness of 0.2 mm by dipping, and the coated material was dried at 110° C. for 5 minutes, thus forming an intermediate layer having a thickness of about 2 μm.

Furthermore, the same charge generating layer as in Example 3 was formed on the above prepared intermediate layer.

Thereafter, 12 g of polycarbonate resin (Panlite K-1300 manufactured by Teijin Limited) was dissolved in 90 g of tetrahydrofuran, and 7 g of the charge transfer material having the following chemical structural formula was added to the above prepared resinous solution.

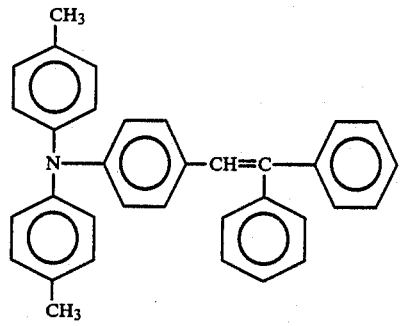

The above prepared solution was coated on the above formed charge generating layer by dipping, and the coated material was dried at 120° C. for 15 minutes, thus forming a charge transfer layer having a thickness of about 20 μm. In this manner, the preparation of a layered type photosensitive material for electrophotography was completed.

COMPARATIVE EXAMPLE 4-a

A comparative photosensitive material was prepared in the same manner as in Example 4, except that the titanium oxide was removed from the intermediate layer.

COMPARATIVE EXAMPLE 4-b

A comparative photosensitive material was prepared in the same manner as in Example 4, except that the electroconductive polymer was removed from the intermediate layer.

Photosensitive properties of the above prepared samples (4 kinds of photosensitive materials of the present invention and 8 kinds of comparative photosensitive materials were measured under the following conditions using an electrostatic paper analizer SP-428 (manufactured by Kawaguchi Denki Seisakusho Co.).

Electrification: 10 seconds (applied voltage = −6 KV)

Dark Decay: 10 seconds

Exposure: 15 seconds (exposure intensity = 5 lux)

The above prepared photosensitive materials were fatigued by carrying out electrification and exposure at the same time for 30 minutes under the above mentioned conditions. Photosensitive properties of these samples thus fatigued were measured, and the results are shown in the following Table-1.

$$\text{(1) Potential Retention Rate} = \frac{\text{Potential after 10 second dark decay}}{\text{Potential after 10 second electrification}}$$

(2) Sensitivity: Exposure amount until potential is decreased to 1/10

(3) Residual Potential: Potential after 15 second exposure.

TABLE 1

| Environmental Condition | Sample | Properties: Initial Value: Potential Retention Rate | Initial Value: Sensitivity (lux-sec) | Initial Value: Residual Potential (V) | After 30 minute-exposure: Potential Retention Rate | After 30 minute-exposure: Sensitivity (lux-sec) | After 30 minute-exposure: Residual Potential (V) |
|---|---|---|---|---|---|---|---|
| 20° C. 65% RH (Normal Humidity) | Example 1 | 0.93 | 2.5 | 0 | 0.92 | 2.4 | 2 |
| | Comparative Ex. 1-a | 0.92 | 3.6 | 10 | 0.90 | 3.6 | 18 |
| | Comparative Ex. 1-b | 0.91 | 2.5 | 0 | 0.88 | 2.6 | 11 |
| | Example 2 | 0.91 | 1.8 | 0 | 0.91 | 1.8 | 0 |
| | Comparative Ex. 2-a | 0.90 | 2.5 | 13 | 0.90 | 2.3 | 20 |
| | Comparative Ex. 2-b | 0.90 | 1.9 | 0 | 0.85 | 1.7 | 7 |
| | Example 3 | 0.83 | 1.9 | 0 | 0.80 | 1.8 | 0 |
| | Comparative Ex. 3-a | 0.81 | 2.7 | 10 | 0.79 | 2.6 | 14 |
| | Comparative Ex. 3-b | 0.83 | 1.8 | 0 | 0.80 | 1.8 | 10 |
| | Example 4 | 0.82 | 1.5 | 0 | 0.81 | 1.4 | 0 |
| | Comparative Ex. 4-a | 0.80 | 2.6 | 8 | 0.80 | 2.7 | 20 |
| | Comparative Ex. 4-b | 0.81 | 1.5 | 0 | 0.76 | 1.6 | 16 |
| 20° C. 15% RH (Low Humidity) | Example 1 | 0.94 | 2.5 | 0 | 0.92 | 2.6 | 3 |
| | Comparative Ex. 1-a | 0.94 | 3.7 | 10 | 0.91 | 3.9 | 15 |
| | Comparative Ex. 1-b | 0.95 | 2.7 | 15 | 0.32 | unmeasurable | 145 |
| | Example 2 | 0.91 | 1.8 | 0 | 0.90 | 1.8 | 2 |
| | Comparative Ex. 2-a | 0.91 | 2.7 | 20 | 0.90 | 2.9 | 28 |
| | Comparative Ex. 2-b | 0.90 | 1.9 | 25 | 0.29 | unmeasurable | 160 |
| | Example 3 | 0.85 | 1.9 | 0 | 0.83 | 1.8 | 5 |
| | Comparative Ex. 3-a | 0.85 | 2.9 | 12 | 0.82 | 3.2 | 15 |
| | Comparative Ex. 3-b | 0.85 | 2.1 | 18 | 0.35 | unmeasurable | 155 |
| | Example 4 | 0.82 | 1.5 | 0 | 0.80 | 1.4 | 0 |
| | Comparative Ex. 4-a | 0.81 | 2.7 | 8 | 0.79 | 2.5 | 10 |
| | Comparative Ex. 4-b | 0.81 | 1.7 | 12 | 0.28 | unmeasurable | 145 |

EXAMPLE 5

Water was added to a polyvinyl alochol (PVA-217 manufactured by Kurashiki Rayon Co., Ltd.) in the presence of heat to prepare a polyvinyl alcohol aqueous solution having a solid content of 5.0% by weight).

200 g of the above prepared polyvinylalcohol aqueous solution, 1.0 g of an anion type electroconductive polymer (ammonium polystyrene sulfonate, "VERSA-TL 125" manufactured by Kanebo NSC Co.) and 8.0 g of titanium oxide powder without surface treatment ("JA-1" having a refractive index of 2.52 manufactured by Teikoku Kako Co.) were dispersed in a ball mill for 5 hours to prepare a coating solution for an intermediate layer. The coating solution thus prepared was coated on the surface of an aluminum plate (electroconductive substrate) having a thickness of 0.2 mm by dipping, and the coated substrate was dried at 120° C. for 5 minutes, thus forming an intermediate layer of a film thickness of about 2.5 μm.

On the other hand, 5 g of polyester resin (manufactured by Toyo Boseki Kabushiki Kaisha) was dissolved in 150 g of cyclohexanone, and 10 g of the same trisazo pigment as used in Example 3 was added to the above prepared resinous solution. The resultant mixture was fully dispersed in a ball mill for 48 hours. Thereafter, 210 g of cyclohexanone was added to the above prepared dispersion, and the resultant dispersion was further dispersed for 3 hours. The dispersion was then poured into a container, and was diluted with cyclohexanone in such a manner as to make a solid content 1.5% by weight while stirring, thus preparing a solution for forming a charge generating layer.

The above prepared solution for forming a charge generating layer was coated on the above formed intermediate layer by dipping, and the coated material was dried at 120° C. for 5 minutes, thus forming a charge generating layer having a thickness of about 0.2 μm.

Furthermore, 12 g of polycarbonate resin (Panlite K-1300 manufactured by Teijin Limited) was dissolved in 90 g of tetrahydrofuran, and 7 g of the same charge transfer material as used in Example 1 was added to the above prepared resinous solution.

The above prepared solution was coated on the above formed charge generating layer by dipping, and the coated material was dried at 120° C. for 15 minutes, thus forming a charge transfer layer having a thickness of about 18 μm. In this manner, the preparation of a layered type photosensitive material for electrophotography was completed.

EXAMPLE 6

A photosensitive material was prepared in the same manner as in Example 5, except that the anion type electroconductive polymer was replaced by a cation type electroconductive polymer.

EXAMPLE 7

A photosensitive material was prepared in the same manner as in Example 5, except that the titanium oxide without surface treatment was replaced by a surface-treated titanium oxide ("Tipaque R-670" having a refractive index of 2.71 manufactured by Ishihara Sangyo Kaisha, Ltd.).

EXAMPLE 8

10 g of an alcohol-soluble copolymerized nylon (CM-8000 manufactured by Toray Industries Inc.) was dissolved in 100 g of methanol. 1 g of an anion type electroconductive polymer (sodium polystyrene sulfonate, "Chemistat 6120" manufactured by Sanyo Chemical Industries Ltd.) and 8 g of titanium oxide powder without surface treatment ("TA-100" having a refractive index of 2.52 manufactured by Fuji Titan Kogyo Co.) were added to the above prepared solution, and the resultant mixture was dispersed in a ball mill for 8 hours, thus preparing a coating solution for an intermediate layer.

The coating solution thus prepared was coated on the surface of an aluminum plate (electroconductive substrate) of a thickness of 0.2 mm by dipping, and the coated substrate was dried at 120° C. for 5 minutes, thus forming an intermediate layer of a film thickness of about 3.5 μm.

On the other hand, 15 g of the same trisazo, pigment as used in Example 5 was added to a resinous solution prepared by dissolving 5 g of butyral resin (manufactured by Sekisui Chemical Co., Ltd.) in 150 g of cyclohexanone. The resultant mixture was dispersed in a ball mill for 48 hours, and the dispersion was continued for 3 hours with the addition of 210 g of cyclohexanone. The dispersion was then poured into a container, and was diluted with cyclohexanone in such a manner as to make a solid content 2.0% by weight while stirring, thus preparing a solution for forming a charge generating layer. The above prepared solution for forming a charge generating layer was coated on the above formed intermediate layer by dipping, and the coated material was dried at 120° C. for 5 minutes, thus forming a charge generating layer having a thickness of about 0.2 μm.

Furthermore, 12 g of polycarbonate resin (Panlite K-1300 manufactured by Teijin Limited) was dissolved in 90 g of tetrahydrofuran, and 7 g of the same charge transfer material as used in Example 4 was added to the above prepared resinous solution.

The above prepared solution was coated on the above formed charge generating layer by dipping, and the coated material was dried at 120° C. for 15 minutes, thus forming a charge transfer layer having a thickness of about 20 μm. In this manner, the preparation of a layered type photosensitive material for electrophotography was completed.

EXAMPLE 9

A photosensitive material was prepared in the same manner as in Example 8, except that the anion type electroconductive polymer was replaced by a cation type electroconductive polymer ("CP-280" manufactured by U.S. Calgon Corp.).

EXAMPLE 10

A photosensitive material was prepared in the same manner as in Example 8, except that the titanium oxide without surface treatment was replaced by a surface-treated titanium oxide ("JRNC" having a refractive index of 2.71 manufactured by Teikoku Kako Co.).

Photosensitive properties of these samples of Examples 5 to 10 were measured in the same manner as in Examples 1 to 4 by using Electrostatic Paper Analyzer SP-428 (manufactured by Kawaguchi Denki Seisakusho Co.). The results are shown in the following Table 2

TABLE 2

| | | Properties | | | | | |
|---|---|---|---|---|---|---|---|
| | | Initial Value | | | After 30 minute-exposure | | |
| Environmental Condition | Sample | Potential Retention Rate | Sensitivity (lux-sec) | Residual Potential (V) | Potential Retention Rate | Sensitivity (lux-sec) | Residual Potential (V) |
| 15° C. | Example 5 | 0.92 | 1.55 | 0 | 0.89 | 1.50 | 2 |
| 10% | Example 6 | 0.92 | 1.65 | 1 | 0.89 | 1.68 | 6 |
| RH | Example 7 | 0.91 | 1.53 | 2 | 0.89 | 1.62 | 25 |
| | Example 8 | 0.90 | 1.29 | 0 | 0.87 | 1.28 | 1 |
| | Example 9 | 0.91 | 1.42 | 0 | 0.89 | 1.45 | 5 |
| | Example 10 | 0.90 | 1.29 | 1 | 0.88 | 1.36 | 21 |

TABLE 2-continued

| Environmental Condition | Sample | Properties: Initial Value: Potential Retention Rate | Initial Value: Sensitivity (lux-sec) | Initial Value: Residual Potential (V) | After 30 minute-exposure: Potential Retention Rate | After 30 minute-exposure: Sensitivity (lux-sec) | After 30 minute-exposure: Residual Potential (V) |
|---|---|---|---|---|---|---|---|
| 20° C. 65% RH | Example 5 | 0.90 | 1.55 | 0 | 0.86 | 1.53 | 1 |
| | Example 6 | 0.91 | 1.63 | 1 | 0.85 | 1.66 | 5 |
| | Example 7 | 0.89 | 1.55 | 0 | 0.86 | 1.51 | 4 |
| | Example 8 | 0.88 | 1.30 | 0 | 0.82 | 1.25 | 0 |
| | Example 9 | 0.89 | 1.42 | 0 | 0.83 | 1.44 | 6 |
| | Example 10 | 0.89 | 1.29 | 0 | 0.82 | 1.27 | 3 |
| 30° C. 85% RH | Example 5 | 0.91 | 1.58 | 0 | 0.87 | 1.58 | 2 |
| | Example 6 | 0.90 | 1.70 | 2 | 0.89 | 1.81 | 11 |
| | Example 7 | 0.90 | 1.56 | 0 | 0.87 | 1.54 | 8 |
| | Example 8 | 0.87 | 1.31 | 0 | 0.81 | 1.29 | 1 |
| | Example 9 | 0.86 | 1.46 | 1 | 0.83 | 1.55 | 10 |
| | Example 10 | 0.86 | 1.30 | 0 | 0.81 | 1.32 | 6 |

EXAMPLE 11

A photosensitive material was prepared in the same manner as in Example 5, except that the substrate was replaced by an aluminum drum having a diameter of 40 mm and a length of 250 mm.

COMPARATIVE EXAMPLE 5-a

A comparative photosensitive material was prepared in the same manner as in Example 11, except that the titanium oxide was replaced by calcium carbonate powder having a refractive index of 1.6 ("Brilliant-15" manufactured by Shiraishi Kogyo Co.).

COMPARATIVE EXAMPLE 5-b

A comparative photosensitive material was prepared in the same manner as in Example 11, except that the titanium oxide was replaced by alumina powder having a refractive index of 1.76 ("UB-20" manufactured by Uemura Kogyo Co.).

An image was developed by applying the above prepared photosensitive materials of Example 11, Comparative Examples 5-a and 5-b to a laser beam printer (LASER-6000 manufactured by Ricoh Co., Ltd.). As a result, the image developed by using the photosensitive material of Example 11 was quite satisfactory, but the images developed by using the photosensitive materials of Comparative Examples 5-a and 5-b caused moire.

As can be seen from the above Examples and Comparative Examples, the photosensitive material of the present invention having an intermediate layer containing a combination of the specific inorganic white pigment with an electroconductive polymer has a high sensitivity and is not easily fatigued. That is, the photosensitive material of the present invention is not affected by severe environmental conditions including temperature, humidity and the like.

Particularly, as can be seen from Examples 5 and 8, the photosensitive material having an intermediate layer containing a combination of a titanium oxide without surface treatment with an anion type electroconductive polymer achieves an excellent effect.

Furthermore, as can be seen from Example 11 and Comparative Examples 5-a and 5-b, the occurrence of moire can not be prevented by the use of an inorganic white pigment having a refractive index of less than 1.9.

What we claim is:

1. A repeatedly usable electrophotographic photosensitive member having an intermediate layer between an electroconductive substrate and an electrophotographic photosensitive layer, said intermediate layer comprising an anionic electroconductive polymer having anionic groups in the polymer molecule and a titanium dioxide pigment without surface treatment, said titanium dioxide pigment having a refractive index of not less than 1.9 on the basis of a visible radiation or a near infrared radiation.

2. The photosensitive member of claim 1, wherein said anionic electroconductive polymer in said intermediate layer is at least one selected from the group consisting of a polymer containing sulfonic acid, a polymer containing an alkali metal salt of sulfonic acid and a polymer containing ammonium sulfonate.

3. The photosensitive member of claim 1, wherein said intermediate layer further contains at least one binder resin selected from the group consisting of polyvinyl alcohol, sodium polyacrylate, carboxymethyl cellulose (CMC), casein, sodium alginate, nylon, copolymerized nylon and alkoxymethylated nylon.

4. The photosensitive of claim 1, wherein said intermediate layer has a thickness of 0.3 to 20 μm.

5. The photosensitive of claim 1, wherein said titanium dioxide pigment is used in an amount of 0.05 to 10 parts by weight per one part by weight of the total amount of said electroconductive polymer and said binder, and said binder is used in an amount of 10 to 200 parts by weight per one part by weight of said electroconductive polymer.

6. The photosensitive of claim 1, wherein said photosensitive layer comprises a charge generating layer and a charge transfer layer.

7. The photosensitive member of claim 6, wherein said charge generating layer contains at least one charge generating material selected from the group consisting of bisazo pigment, trisazo pigment, phthalocyanine pigment, perylene pigment, squaric pigment, indigo pigment, selenium powder, selenium alloy powder, amorphous silicon powder, zinc oxide powder and cadmium sulfide powder.

8. The photosensitive member of claim 6, wherein said charge transfer layer contains at least one charge transfer material selected from the group consisting of hydrazone compounds, styryl compounds, pyrazoline compounds and oxadiazole compounds.

9. The photosensitive member of claim 1, wherein said intermediate layer consists essentially of said anionic electroconductive polymer, said titanium dioxide pigment without surface treatment and a binder resin.

10. A repeatedly usable electrophotographic photosensitive member having an intermediate layer between an electroconductive substrate and an electrophotographic photosensitive layer, said intermediate layer comprising a polymer containing anionic ion-exchange groups in the polymer molecule and a titanium dioxide pigment without surface treatment, said titanium dioxide pigment having a refractive index of not less than 1.9 on the basis of a visible radiation or a near infrared radiation.

11. The photosensitive member of claim 10, wherein said intermediate layer further contains at least one binder resin selected from the group consisting of polyvinyl alcohol, sodium polyacrylate, carboxymethyl cellulose (CMC), casein, sodium alignate, nylon, copolymerized nylon and alkoxymethylated nylon.

12. The photosensitive member of claim 11, wherein said titanium dioxide pigment is used in an amount of 0.05 to 10 parts by weight per one part by weight of the total amount of said electroconductive polymer and said binder, said binder being used in an amount of 10 to 200 parts by weight per one part by weight of said electroconductive polymer.

13. The photosensitive member of claim 10, wherein said photosensitive layer comprises a charge generating layer and a charge transfer layer, said charge generating layer containing at least one charge generating material selected from the group consisting of bisazo pigment, trisazo pigment, phthalocyanine pigment, perylene pigment, squaric pigment, indigo pigment, selenium powder, selenium alloy powder, amorphous silicon powder, zinc oxide powder and cadmium sulfide powder.

14. The photosensitive member of claim 13, wherein said charge transfer layer contains at least one charge transfer material selected from the group consisting of hydrazone compounds, styryl compounds, pyrazoline compounds and oxadiazole compounds.

15. The photosensitive member of claim 10 in which said polymer is selected from the group consisting of ammonium polystyrene sulfonate and sodium polystyrene sulfonate.

* * * * *

UNITED STATES PATENT AND TRADEMARK OFFICE

CERTIFICATE OF CORRECTION

PATENT NO. : 4 775 605

DATED : October 4, 1988

INVENTOR(S) : Kenji SEKI et al

It is certified that error appears in the above-identified patent and that said Letters Patent is hereby corrected as shown below:

Column 14, line 38; after "photosensitive" insert ---member---.

line 40; after "photosensitive" insert ---member---.

change "claim 1" to ---claim 3---.

line 47; after "photosensitive" insert ---member---.

Signed and Sealed this

Eleventh Day of July, 1989

*Attest:*

*Attesting Officer*

DONALD J. QUIGG

*Commissioner of Patents and Trademarks*